US010255767B2

(12) United States Patent
Rucker

(10) Patent No.: US 10,255,767 B2
(45) Date of Patent: Apr. 9, 2019

(54) SYSTEM AND METHOD OF ALLOWING A PLAYER TO PLAY GAMING MACHINES HAVING DYNAMIC POSITION FUNCTIONALITY

(71) Applicant: Konami Gaming, Inc., Las Vegas, NV (US)

(72) Inventor: Keith Rucker, Las Vegas, NV (US)

(73) Assignee: KONAMI GAMING, INC., Las Vegas, NV (US)

( * ) Notice: Subject to any disclaimer, the term of this patent is extended or adjusted under 35 U.S.C. 154(b) by 369 days.

(21) Appl. No.: 14/826,097

(22) Filed: Aug. 13, 2015

(65) Prior Publication Data

US 2016/0063802 A1 Mar. 3, 2016

(30) Foreign Application Priority Data

Aug. 29, 2014 (AU) ..... 2014218449

(51) Int. Cl.
*G07F 13/00* (2006.01)
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
CPC ..... G07F 17/32
See application file for complete search history.

(56) References Cited

U.S. PATENT DOCUMENTS

| | | | | |
|---|---|---|---|---|
| 7,824,260 | B2 | 11/2010 | Aida | |
| 8,052,515 | B2 | 11/2011 | Nakamura | |
| 8,096,869 | B2 | 1/2012 | Yoshimi | |
| 8,303,397 | B2 | 11/2012 | Mizue | |
| 9,153,091 | B2 * | 10/2015 | Berman | G07F 17/32 |
| 9,177,447 | B2 * | 11/2015 | Zoltewicz | G07F 17/326 |
| 2004/0033827 | A1 * | 2/2004 | Gilmore | G07F 17/32 463/20 |
| 2005/0049030 | A1 * | 3/2005 | Tachikawa | G07F 17/3267 463/20 |
| 2006/0025215 | A1 * | 2/2006 | Thomas | G07F 17/3211 463/30 |
| 2006/0183534 | A1 * | 8/2006 | Yoshimi | G07F 17/34 463/20 |

(Continued)

OTHER PUBLICATIONS

Australian Patent Examination Report No. 3 dated Nov. 4, 2015 for Australian Patent Application No. 2014218449.

(Continued)

*Primary Examiner* — Reginald Renwick
(74) *Attorney, Agent, or Firm* — Howard & Howard Attorneys PLLC

(57) ABSTRACT

The game machine comprising a display device and a controller is provided. The display device is configured to display a game. The controller is configured to display a plurality of reels, the reels reach displaying a plurality of symbols. Each reel includes at least one activation zone with each activation zone have at least one symbol. The controller is configured to determine the number of symbols within the activation zone, randomly determine an outcome of the game, and display the outcome of the game including the activation zone. The activation zone includes a determined number of symbols.

29 Claims, 13 Drawing Sheets

(56) References Cited

U.S. PATENT DOCUMENTS

| | | | | |
|---|---|---|---|---|
| 2008/0032776 | A1* | 2/2008 | Okada | G07F 17/34 463/20 |
| 2008/0108411 | A1 | 5/2008 | Jensen et al. | |
| 2008/0188286 | A1 | 8/2008 | Jaffe | |
| 2009/0221352 | A1 | 9/2009 | Nakano | |
| 2009/0286588 | A1* | 11/2009 | Jackson | G07F 17/34 463/20 |
| 2010/0210343 | A1 | 8/2010 | Englman et al. | |
| 2011/0201406 | A1 | 8/2011 | Jaffe et al. | |
| 2011/0223985 | A1 | 9/2011 | Mizue | |
| 2013/0184050 | A1 | 7/2013 | Zoble et al. | |
| 2013/0324208 | A1 | 12/2013 | Ryan | |

OTHER PUBLICATIONS

Patent Examination Report No. 1 (AU 2015252105) dated Aug. 3, 2016.

* cited by examiner

SYSTEM AND METHOD OF ALLOWING A PLAYER TO PLAY GAMING MACHINES HAVING DYNAMIC POSITION FUNCTIONALITY

CROSS REFERENCE TO RELATED APPLICATION

This application claims priority to Australian Patent Application No. 2014218449, filed Aug. 29, 2014, the disclosure of which is hereby incorporated by reference in its entirety.

COPYRIGHT NOTICE

A portion of this disclosure contains material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The present invention relates to gaming machines for the playing of games of chance and, more particularly, to special features of games or feature games which may be offered on such machines.

BACKGROUND OF THE INVENTION

Gaming machines, such as slot machines, are a cornerstone of the gaming industry. Some known gaming machines include a video display device to display a reel game that includes a plurality of reels, wherein each reel includes a plurality of symbols. During game play, the gaming machine accepts a wager from a player, the player selects one or more paylines, the gaming machine spins the reels, and sequentially stops each reel to display the generated combination of symbols on the reels. The gaming machine then awards the player an award based on the combination of symbols orientated along the selected payline.

Traditionally such machines were mechanical devices where a number of reels marked with a plurality of numbers or symbols could be made to spin randomly by the application of some mechanical input. If the subsequent patterns of numbers or symbols displayed on the reels, when these returned to a rest state, corresponded to predetermined patterns, the machine would provide a prize or payout. Generally such gaming machines have come to be regulated by government authorities as to their number and in the manner in which the machines must return a percentage of the monetary turnover to the players.

The introduction of electronics, computers and electronic graphical displays, has allowed a continual increase in the complexity and variations of gaming machines, games and displays while maintaining the basic concept of the traditional machine. Nevertheless, in some jurisdictions at least, government regulations effectively restrict the degree of variation which may be incorporated in games played on coin-freed machines.

Machines and games therefore that offer novel and stimulating variations on the basic game theme and environment, yet comply with these restrictions are eagerly sought by the gaming industry and there is consequently intense competition between machine manufacturers to innovate.

Games based on simulated rotatable reels typically display a matrix of elements each of which displays a symbol. Predetermined patterns of symbols, if displayed after the reels are spun and come to rest, may then award a prize to the player of the game. Typically also, the symbols are arranged in the elements of a reel so that adjoining elements do not display the same symbol.

An exception to this is found for example in Australian Patent Application No. 2004203045 (Aristocrat Technologies Australia Pty Ltd), in which arrangements are envisaged where two special symbols may occur adjacent to each other. A similar exception is found in Australian Patent Application No. 2002301067 (Stargames Corporation Limited), in which a specific symbol and the number of its occurrences in the display at the conclusion of a game sequence, is determinant of a win. As indicated in FIG. 2 of the specification, two such symbols may appear in adjoining elements of a reel. Both these examples of the prior art allow for only a single predetermined or special symbol to take up such adjacent positions on a reel.

It is an object of the present invention to address or at least ameliorate some of the above disadvantages.

BRIEF SUMMARY OF INVENTION

In one aspect of the present invention, a game machine for providing a game to a player is provided. The machine comprises a display device and a controller. The display device is configured to display a game. The controller is configured to display a plurality of reels, the reels reach displaying a plurality of symbols. Each reel includes at least one activation zone with each activation zone have at least one symbol. The controller is configured to determine the number of symbols within the activation zone, randomly determine the outcome of the game, and display the outcome of the game including the activation zone. The activation zone then includes a determined number of symbols.

In another aspect of the present invention, a method of providing a game to a player through a game machine is provided. The game includes a plurality of reels displaying a plurality of symbols. At least one reel includes an activation zone and the activation has at least one symbol. The method includes a display device and a controller. The method comprises the steps of: displaying the game through the display device, determining the number of symbols within the activation zone, randomly determining an outcome of the game, and displaying the outcome of the game including the activation zone. The activation zone then includes the determined number of symbols.

In another aspect of the present invention, a non-transitory information recording medium containing a computer readable program that functions as a game machine for providing a game to a player is provided. The machine comprises a display device and a controller. The display device is configured to display a game. The controller is configured to display a plurality of reels, the reels reach displaying a plurality of symbols. Each reel includes at least one activation zone with each activation zone have at least one symbol. The controller is configured to determine the number of symbols within the activation zone, randomly determine the outcome of the game, and display the outcome of the game including the activation zone. The activation zone then includes a determined number of symbols.

BRIEF DESCRIPTION OF THE DRAWINGS

Other advantages of the present invention will be readily appreciated as the same becomes better understood by reference to the following detailed description when considered in connection with the accompanying drawings.

Corresponding reference characters indicate corresponding parts throughout the drawings.

DETAILED DESCRIPTION OF THE INVENTION

With reference to the drawings and in operation, the present invention overcomes at least some of the disadvantages of known gaming machines by providing a gaming machine and methods that incorporate dynamic position functionality features.

A selected embodiment of the present invention will now be explained with reference to the drawings. It will be apparent to those skilled in the art from this disclosure that the following description of the embodiments of the present disclosure is provided for illustration only and not for the purpose of limiting the disclosure as defined by the appended claims and their equivalents.

Referring to the figures, where like numerals generally indicate like or corresponding parts throughout the several views, the systems and methods are constructed in accordance with the disclosure.

Gaming Machine

Figure 1:
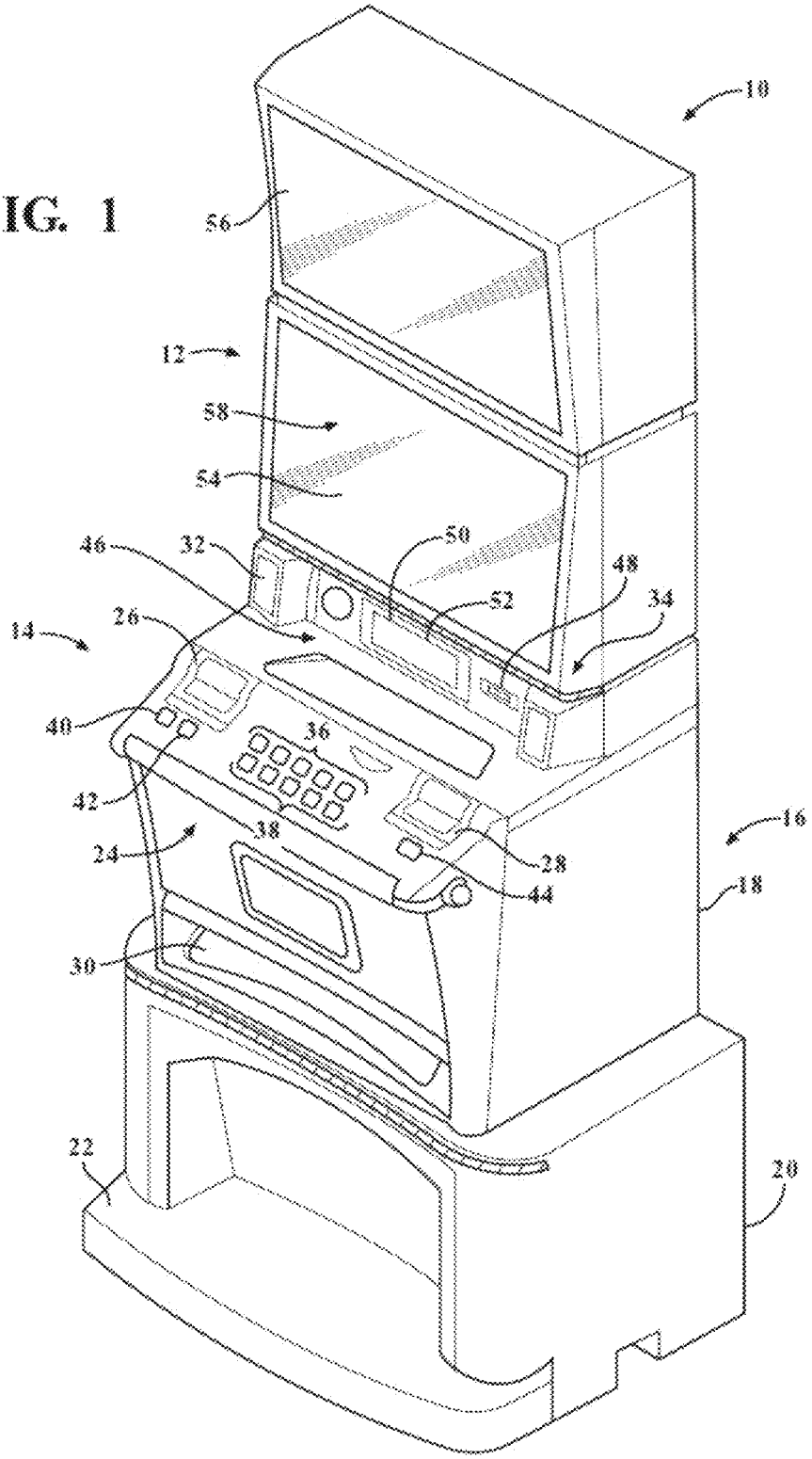
FIG. 1 is a perspective view of an exemplary gaming machine.
Figure 2:
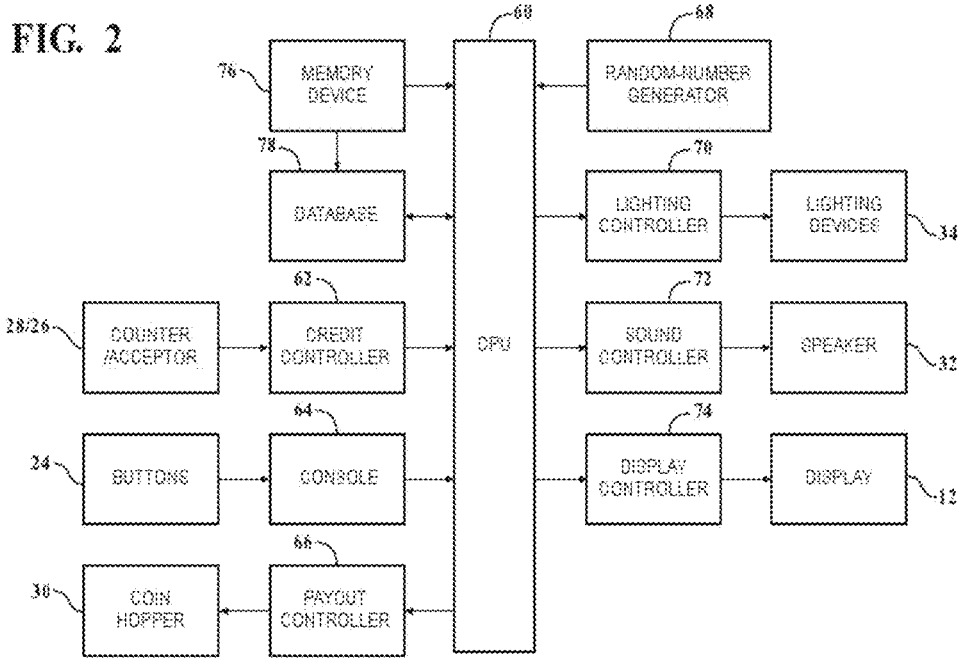
FIG. 2 is a schematic representation of the gaming machine.

FIG. 1 is a perspective view of an exemplary gaming machine 10. FIG. 2 is a schematic representation of the gaming machine 10. A preferred embodiment of the present invention is a video gaming machine preferably installed in a casino. In the illustrated embodiment, the gaming machine 10 includes a display device 12 for displaying a plurality of games, a user input device 14 to enable a player to interface with the gaming machine 10, and a gaming controller 16 that is operatively coupled to the display device 12 and the user input device 14 to enable a player to play games displayed on the display device 12. The gaming machine 10 also includes a cabinet assembly 18 that is configured to support the display device 12, the user input device 14, and/or the gaming controller 16 from a gaming stand 20 and/or a supporting surface 22.

The display device 12 and the user input device 14 are coupled to the cabinet assembly 18 and are accessible by the player. In one embodiment, the gaming controller 16 is positioned within the cabinet assembly 18. Alternatively, the gaming controller 16 may be separated from the cabinet assembly 18, and connected to components of the gaming machine 10 through a network such as, for example, a local area network (LAN), a wide area network (WAN), dial-in-connections, cable modems, wireless modems, T1, T3, fiber, and/or special high-speed Integrated Services Digital Network (ISDN) lines.

In one embodiment, the user input device 14 includes a plurality of input buttons 24, a coin slot 26, and/or a bill acceptor 28. The coin slot 26 includes an opening that is configured to receive coins and/or tokens deposited by the player into the gaming machine 10. The gaming machine 10 converts a value of the coins and/or tokens to a corresponding amount of gaming credits that are used by the player to wager on games played on the gaming machine 10.

The bill acceptor 28 includes an input and output device that is configured to accept a bill, a ticket, and/or a cash card into the bill acceptor 28 to enable an amount of gaming credits associated with a monetary value of the bills, ticket, and/or cash card to be credited to the gaming machine 10. Moreover, the gaming machine 10 may also utilize a cashless wagering system (not shown), such as a ticket in ticket out (TITO) system (not shown). In one embodiment, the bill acceptor 28 also includes a printer (not shown) that is configured to dispense a printed voucher ticket that includes information indicative of an amount of credits and/or money paid out to the player by the gaming machine 10 during a gaming session. The voucher ticket may be used at other gaming machines, or redeemed for cash, and/or other items as part of a casino cashless system (not shown).

A coin tray 30 is coupled to the cabinet assembly 18 and is configured to receive a plurality of coins that are dispensed from the gaming machine 10. One or more speakers 32 are installed inside the cabinet assembly 18 to generate voice announcements and/or sound effects associated with game play. The gaming machine 10 also includes one or more lighting devices 34 that are configured to blink and/or change brightness and color in specific patterns to produce lighting effects to enhance a visual gaming experience for the player.

In one embodiment, the input buttons 24 include a plurality of BET switches 36 for inputting a wager on a game, a plurality of selection switches 38 for selecting a betting line and/or card, a MAXBET switch 40 for inputting a maximum wager, a PAYOUT switch 42 for ending a gaming session and dispensing accumulated gaming credits to the player, and a start switch, i.e., a SPIN/DEAL button 44 to initiate an output of a game.

In the illustrated embodiment, the BET switches 36 include five switches from 1BET to 5BET to enable a player to wager between a minimum bet up to 5× minimum bet. Each selection switch 38 corresponds to a betting line such as, for example, a payline and/or symbol for a reel game, one or more cards for a card game, and/or a symbol for a roulette game, to enable a player to associate a wager with one or more betting lines. The MAXBET switch 40 enables a player to input the maximum bet that a player can spend against one time of a game. The PAYOUT switch 42 enables a player to receive the amount of money and/or credits awarded to the player during a gaming session, which has been credited onto the gaming machine 10.

The gaming machine 10 may also include a player tracking device 46 that is coupled to the gaming controller 16 for identifying the player and/or a player tracking account that is associated with the player. The player tracking account may include, but is not limited to, gaming credits available to the player for use in playing the gaming machine 10. The player tracking device 46 is configured to communicate player account information between a player tracking controller (not shown) and the gaming machine 10. For example, the player tracking device 46 may be used to track bonus points and/or credits awarded to the player during a gaming session and/or track bonus and/or credits downloaded to the gaming machine 10 from the player tracking system.

The player tracking device 46 is coupled to the gaming cabinet assembly 18 and includes a player identification card reader 48, a data display 50, and a keypad 52. The player identification card reader 48 is configured to accept a player tracking card (not shown) inserted by the player, and read information contained on the player tracking card to identify the player account information. The player identification card reader 48 may include, but is not limited to, a barcode reader, a magnetic card reader, and/or a radio frequency identification (RFID) card reader. The keypad 52 is configured to accept a user selection input such as, for example, a unique player personal identification number (PIN) to facilitate enabling the gaming machine 10 to identify the player, and access player account information associated with the identified player to be displayed on the data display 50. In one embodiment, the data display 50 includes a touchscreen panel that includes the keypad 52. Alternatively, the data display 50 and the keypad 52 may be included in the display device 12.

In one embodiment, the display device 12 includes a first display 54 and a second display 56. The first display 54 is configured to display a game screen 58 including indicia and/or symbols for use in a game, e.g., cards used by a card game, roulette wheel and symbols used in a roulette game, and reels used in a reel game. The game screen 58 may include any type of game including, but not limited to, a video slot game, a keno game, a blackjack game, a video poker game, or any type of game which allows a player to make a wager, play a game, and potentially provide the player an award based on an outcome of the game and a paytable. The second display 56 is configured to display game play instructions for performing the game including, but not limited to, playing instructions, paytables, paylines, betting lines and/or any other information to enable the gaming machine 10 to function as described herein. Moreover, each display 54 and 56 may be configured to display at least a portion of the game screen 58 and/or game play instructions. In one embodiment, the first and second displays 54 and 56 each include a flat panel display, such as a cathode ray tube display (CRT), a liquid crystal display (LCD), a light-emitting diode display (LED), a plasma display, and/or any suitable visual output device capable of displaying graphical data and/or text to a user. Alternatively, a single component, such as a touch screen, may function as both the display device 12 and as the user input device 14. In an alternative embodiment, the first display 54 and/or the second display 56 includes a plurality of mechanical reels displaying a plurality of game symbols.

Referring to FIG. 2, in one embodiment, the gaming controller 16 includes a processor, i.e., a central processing unit (CPU) 60, a credit controller 62, a console unit 64, a payout controller 66, a random-number generator (RNG) 68, a lighting controller 70, a sound controller 72, a display controller 74, a memory device 76, and a database 78. Memory device 76 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 60 to store, retrieve, and/or execute instructions and/or data.

The CPU 60 executes various programs, and thereby controls other components of the gaming controller 16 according to player instructions and data accepted by the user input device 14. The CPU 60 in particular executes a game program, and thereby conducts a game in accordance with the embodiments described herein. The memory device 76 stores programs and databases used by the CPU 60. Moreover, the memory device 76 stores and retrieves information in the database 78 including, but not limited to, a game type, a number of reels associated with a game, a number of reel strips associated with each reel, a number of symbol positions being displayed on each reel strip, a type of symbols being displayed on each symbol position, a predefined set of normal symbols, a predefined set of special symbols, image data for producing game images and/or screens on the display device 12, and temporarily stores variables, parameters, and the like that are used by the CPU 60. In addition, the memory device 76 stores indicia, symbol weights, pay tables, and/or winning combination tables which represent relationships between combinations of random numbers and types of awards. In one embodiment, the memory device 76 utilizes RAM to temporarily store programs and data necessary for the progress of the game, and EPROM to store, in advance, programs and data for controlling basic operation of the gaming machine 10, such as the booting operation thereof.

Any combination of the components above may be referred to as the "controller" generally in order to execute the game mechanics for which the system is configured as well as to perform the steps described below. Furthermore, additional components may also contribute to the functionality of the "controller" generally as required by the system and method within the further embodiments of this invention.

The credit controller 62 manages the amount of player's credits, which is equivalent to the amount of coins and bills counted and validated by the bill acceptor 28. The console unit 64 is coupled to the user input device 14 to monitor player selections received through the input buttons 24, and accept various instructions and data that a player enters through the input buttons 24. The payout controller 66 converts a player's credits to coins, bills, or other monetary data by using the coin tray 30 and/or for use in dispensing a credit voucher via the bill acceptor 28.

The lighting controller 70 controls one or more lighting devices 34 to blink and/or change brightness and color in specific patterns in order to produces lighting effects associated with game play. The sound controller 72 controls the speakers 32 to output voice announcements and sound effects during game play. The display controller 74 controls the display device 12 to display various images on screens preferably by using computer graphics and image data stored in the memory device 76. More specifically, the display controller 74 controls video reels in a game screen displayed on the first display 54 and/or the second display 56 by using computer graphics and the image data.

The RNG 68 generates and outputs random numbers to the CPU 60 preferably at the start of each round of game. The CPU 60 uses the random numbers to determine an outcome of a game. For example, if the game is a video slot game, the CPU 60 uses the RNG 68 to randomly select an arrangement of symbols to be displayed on video reels. Moreover, the CPU 60 generally uses random numbers generated by the RNG 68 to play the games, and to determine whether or not to provide an award to a player. In addition, the CPU 60 generates game outcomes including combinations of random numbers, and compares the generated combinations with winning combinations stored in the winning combination table to determine if the generated outcome is a winning outcome that is associated with a type of award.

Figure 3:
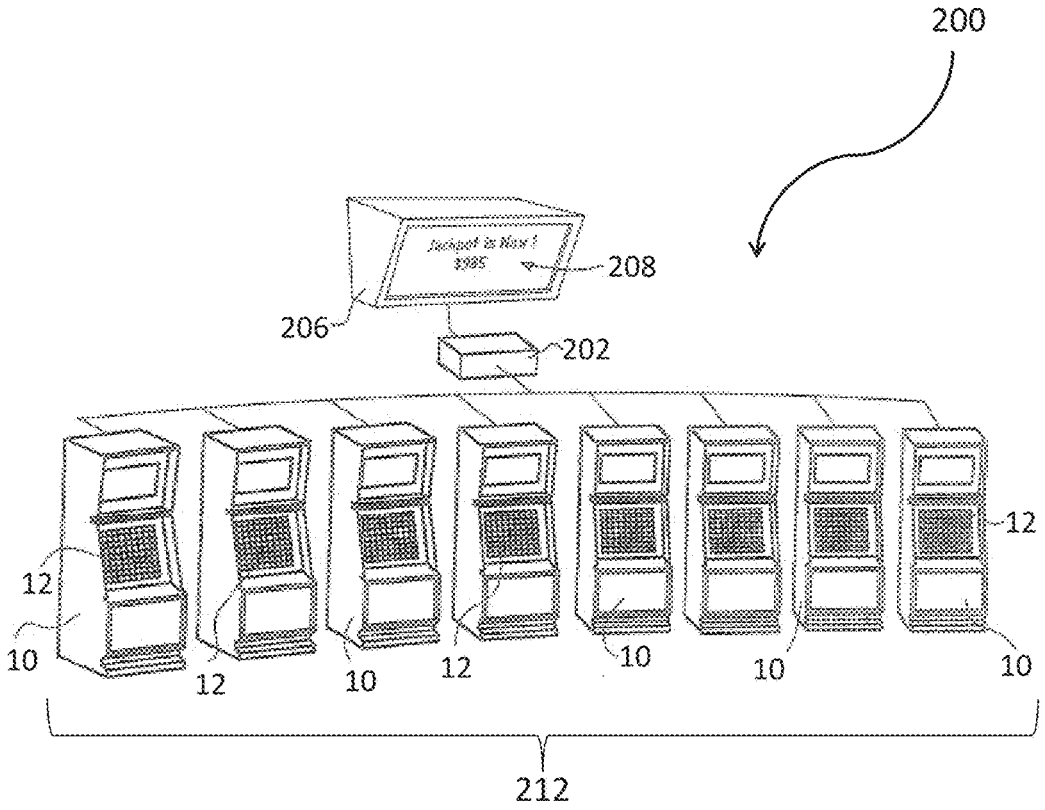
FIG. 3 is a drawing of multiple game machines connected to a progressive jackpot system, according to one industrial embodiment of the invention.

FIG. 3 is a schematic view of an exemplary gaming system 200. The gaming system 200 includes a system controller 202 and one or more gaming terminals 204 that are coupled to the system controller 202. The gaming system 200 may also include a central display device 206, including a central display 208, coupled to the system controller 202 for displaying games played on one or more of the gaming machines 10. In the illustrated embodiment, the gaming terminal 204 includes the gaming machine 10. In another embodiment, gaming terminal 204 may include a personal computer, laptop, cell phone, smartphone, tablet computer, personal data assistant, and/or any suitable computing device that enables a player to connect to system controller 202 to play the game 80.

In the illustrated embodiment, the gaming machine 10 and the system controller 202 are coupled in communication with a local area network (LAN) 210. Alternatively, the gaming machine 10 and the system controller 202 may be coupled via a network such as, for example, an Internet link, an intranet, a WAN, dial-in-connections, cable modems, wireless modems, and/or ISDN lines. In the illustrated embodiment, the gaming system 200 includes eight gaming machines 10 arranged in a bank 212, i.e., are arranged together, adjacently. It should be noted, however, that the gaming system 200 may include any number of gaming machines 10 that may be arranged in any manner, such as in a circle or along a curved arc, or positioned within separate areas of a casino floor, and/or separate gaming establishments such as different casinos. Furthermore, additional groups of gaming machines 10 may be coupled to the system controller 202. In one embodiment, the system controller 202 may be implemented by one of the gaming controllers 16 associated with a gaming machine 10. In still another embodiment, the system controller 202 may be located remotely with respect to gaming machine 10, or within one of the gaming machine cabinet assemblies 18 (shown in FIG. 1). The system controller 202 is configured to perform all of the functions of the gaming controller 16 as described herein.

In the illustrated embodiment, the system controller 202 determines if a triggering event occurs in a game outcome being played at one or more of the gaming machines 10, and displays a bonus game such as, for example, the game 80 on the central display 206 if the triggering event occurs. Alternatively, the system controller 202 may display the game 80 at one or more gaming machines 10 based on one or more triggering events occurring in games played at the gaming machine 10. The triggering event may be the appearance of a predefined symbol and/or a predefined symbol combination in a game outcome.

Figure 4:
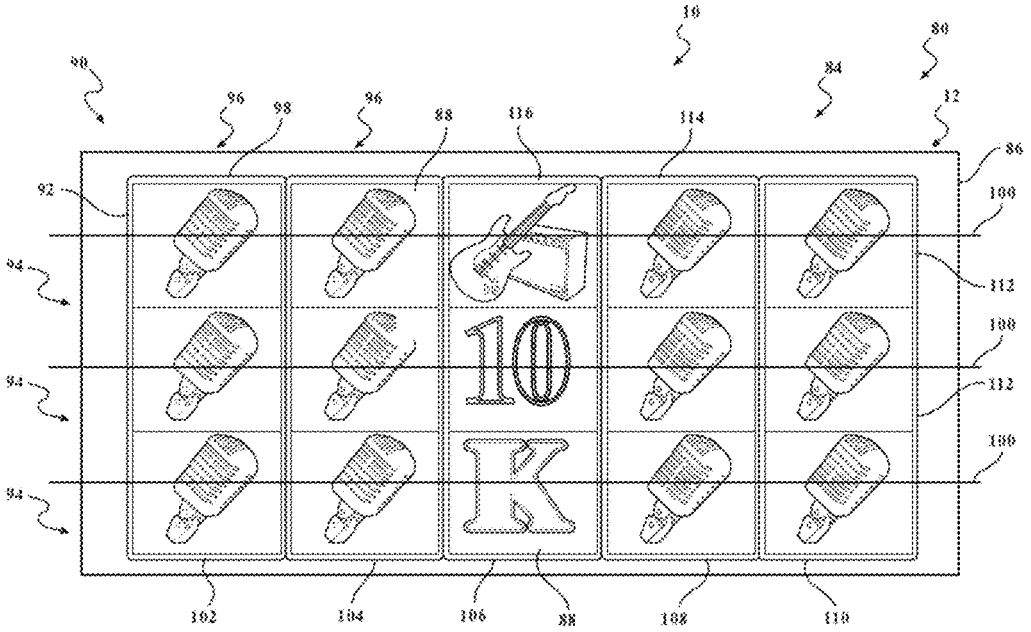
FIG. 4 is an exemplary graphical display of a game 80 that is displayed by the gaming machine 10 shown in FIG. 1.
Figure 5:
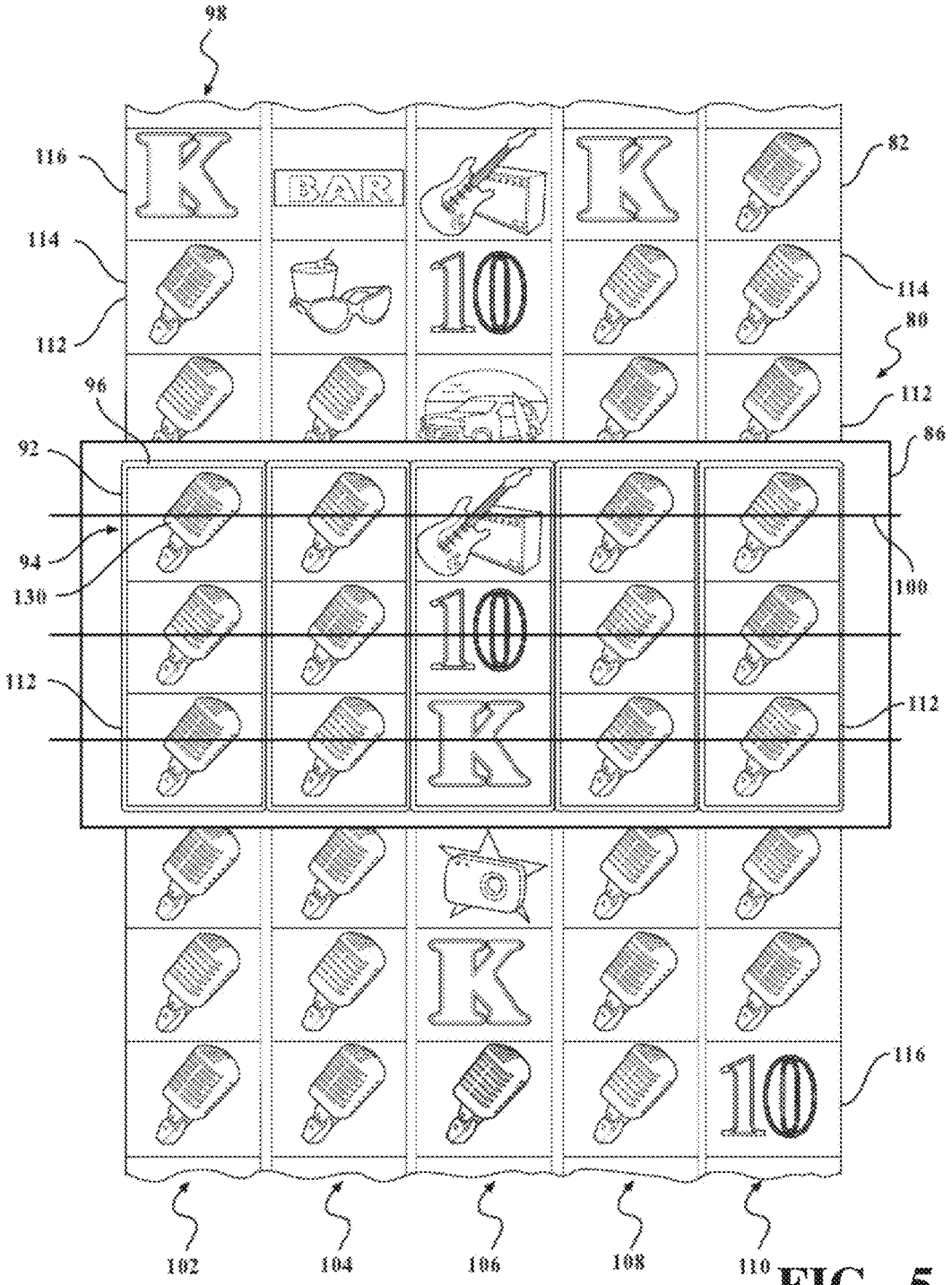
FIG. 5 is a showing of portions of adjoining simulated reels according to an embodiment of the present invention.
Figure 6:
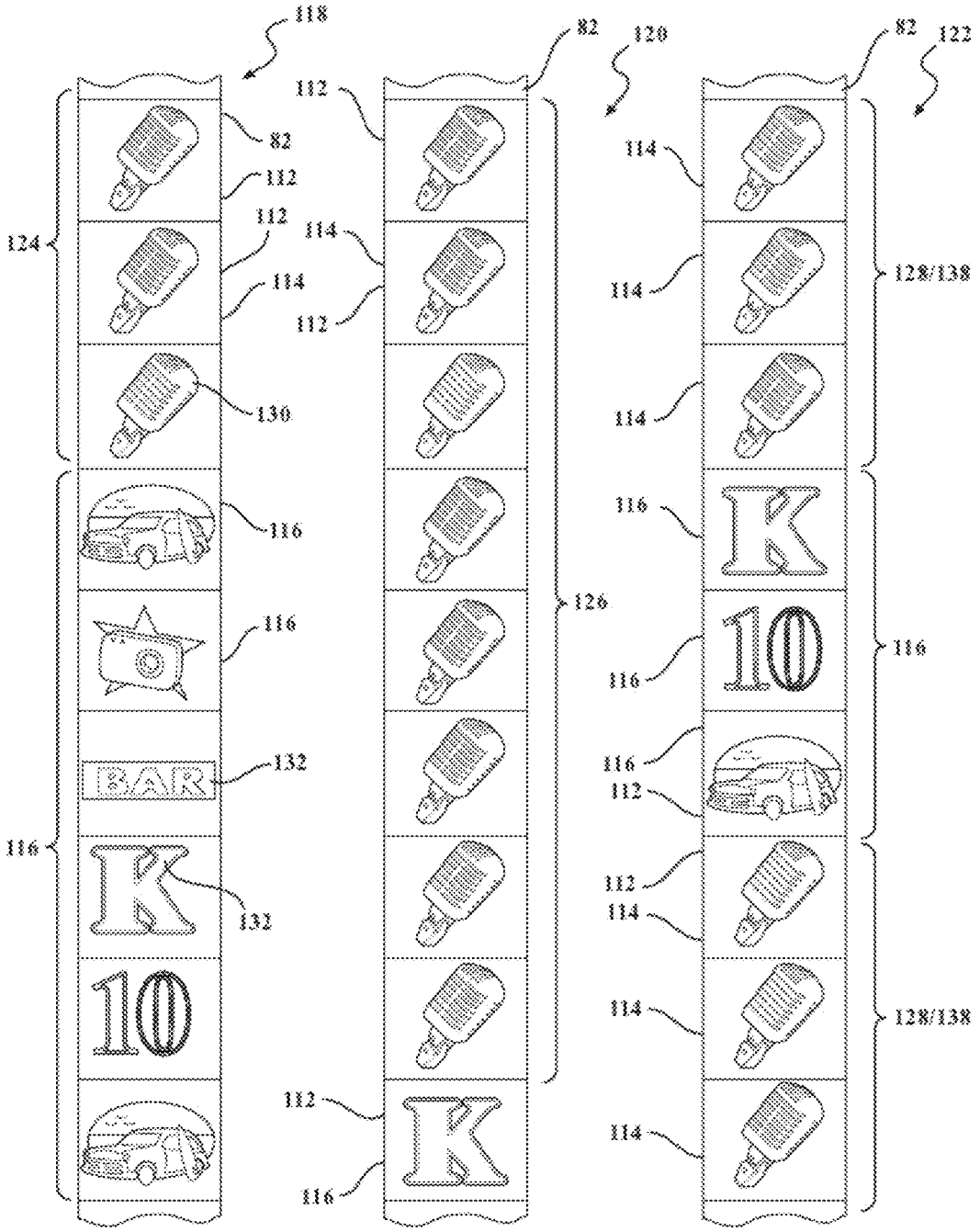
FIG. 6 is a schematic representation of a plurality of reel strips that may be used in the game 80 shown in FIG. 1.

FIG. 3 is an exemplary graphical display of a game 80 that is displayed by the gaming machine 10 shown in FIG. 1. FIG. 4 is a schematic representation of a portion of the gaming machine 10 including the game 80. FIG. 5 is a schematic representation of a plurality of reel strips 82 that may be used the game 80 shown in FIG. 3. In the illustrated embodiment, the gaming controller 16 is configured to display the game 80 on the display device 12. In one embodiment, the game 80 is a video slot game. However, it should be noted that the game 80 may be any type of game upon which a player could make a wager including, but not limited to a keno game, a blackjack game, a video poker game, or any type of game that enables the gaming machine 10 to function as described herein. In the illustrated embodiment, the game 80 is displayed on the first display 54. Alternatively, the game 80 may be displayed on the first display 54 and/or the second display 56.

In general, during play of the main game 80, the gaming controller 16 randomly generates an outcome 84 of the main game 80 and displays the generated game outcome 84 in a display area 86. The gaming controller 16 randomly selects a plurality of game symbols 88 from a predefined set of possible game symbols and displays the selected game symbols 88 associated with the generated game outcome 84 in the game display area 86.

In the illustrated embodiment, the plurality of game symbols 88 are displayed in a grid 90 having a plurality of cells 92 arranged along a plurality of rows 94 and a plurality of columns 96. Each cell 92 displays one or more game symbols 88 associated with the game outcome 84. In the illustrated embodiment, the gaming controller 16 displays the game symbols 88 within a plurality of reels 98. Each reel 98 is associated with a corresponding column 96. The main game 80, in one embodiment, includes 5 reels 98 with 3 cells 92 displayed in the display area 86 per reel 98 (a "3×5" arrangement). Alternatively, other reel arrangements may be used such as, for example, 4, 5, 5, 5, and 4 cells per reel, respectively (a "4-5-5-5-4" arrangement), 3-4-3-4-3, or 4-5-4-5-4 arrangements or arrangements with the same number of cells per column, such as 3×3, 3×4, 4×5, or 5×5 configurations. The main game 80 also includes a plurality of paylines 100 that extend across one or more cells 92 to indicate, to the player, a combination of game symbols 88. In one embodiment, the gaming machine 10 displays the main game 80 via a plurality of mechanical reels (not shown) that include a plurality of symbols displayed on a circumferential surface of each reel.

Each slot game is generally played in a conventional manner. The player makes a wager, which may be based on a predetermined denomination and a selected number of paylines, the gaming controller 16 randomly generates an outcome for the game, spins the reels, and selectively stops the reels to display a game symbol 88 in each of the display cells 92. If a predetermined pattern of symbols 88 is randomly chosen for each cell 92 associated with a played payline 100, the player may be awarded a payout based on the payline, the wager, and a predetermined paytable. Moreover, the player may be awarded a payout if the combination of symbols associated with a selected payline is a winning combination. In addition, a player may receive a bonus feature and/or a bonus game based on the combination of symbols associated with the selected payline and/or the appearance of one or more predefined symbols in the game outcome 84. Many variations to the above described general play of a slot game fall within the scope of the present invention. Such slot games are well-known in the art, and are therefore not further discussed.

In the illustrated embodiment, the gaming machine 10 receives a signal, from the user input device 14, that is indicative of a player's selection to initiate a gaming session including a wager amount, and a selection of one or more paylines 100 associated with a predefined set of cells 92 within the displayed grid 90. In the illustrated embodiment, the gaming machine 10 is a multi-line game, i.e., the paylines include horizontal paylines and/or diagonal paylines, and/or zig-zag paylines. Moreover, the user input device 14 may allow the player to toggle to increase the bet per payline a credit at a time (up to the maximum bet). The gaming controller 16 randomly generates an outcome of the main game 80, and displays the generated outcome on the display device 12. In one embodiment, the gaming controller 16 is configured to rotate, and/or spin each reel 98 to initiate a game play, and stop each reel 98 to display a plurality of symbols 88 associated with the randomly generated outcome. In addition, the gaming controller 16 is adapted to determine if the generated outcome is a winning outcome based on the displayed game symbols 88, a pay-table, a wager, and one or more selected paylines 100. More specifically, the gaming machine 10 determines if a combination of symbols 88 arranged along the selected payline 100 is a winning combination. The gaming controller 16 may provide an award in response to the outcome of the main game 80. In general, the term "award" may be a payout, in terms of credits or money. Thus, gaming controller 16 may award a regular payout in response to the outcome of the main game 80. However, it should be noted that the term award may also refer to other types of awards, including, prizes, e.g., meals, show tickets, etc . . . , as well as in-game awards, such as free games or awarding the player one or more wild symbols or stacked wild symbols in each of the games.

The gaming controller 16 is configured to display the game 80 including a plurality of reels 98. For example, in one embodiment, the gaming controller 16 displays the game 80 having five reels 98 orientated horizontally including a $1^{st}$ reel 102, a $2^{nd}$ reel 104, a $3^{rd}$ reel 106, a $4^{th}$ reel 108, and a $5^{th}$ reel 110. Each reel 98 may have a plurality of associated reel strips 82 that may be displayed on the respective reel 98. Each reel strip 82 includes a plurality of symbol positions 112. During display of the generated game outcome 84, the gaming controller 16 selects a reel strip 82 to be displayed on at least one of the reels 98, selects a plurality of game symbols 88 being displayed in each of the symbol positions 112 of each selected reel strip 82, and spins each reel 98 such the game symbols 88 are moved through each of the cells 92 in the display area 86.

The gaming controller 16 randomly selects one of the first reel strip 118, the second reel strip, and the third reel strip 122 and displays the selected reel strip 82 with the first reel 102. In addition, the gaming controller 16 may randomly select at least one special symbol 130 from a plurality of special symbols including a predefined set of special symbols 130 and displays the selected special symbol 130 displayed within each special symbol position 114. The gaming controller 16 spins and stops the first reel 102 to display the generated game outcome 84 within the display area 86 including the selected reel strip 82 having the selected special symbol 130 being displayed in each special symbol position 114.

The illustrated embodiment can also include a bonus feature or secondary game in addition to the main game on the gaming machine. The bonus feature or secondary game is an add-on to the main game utilizing any in-game machine asset. A bonus feature or secondary game is considered an add-on to the main game that occurs during game play. The bonus feature or secondary game can used any in-game machine asset that is used to display an award related to the main game. Such awards include free spins, credits, a credit multiplier, or additional pseudo game-play unrelated to the main game. The bonus feature or secondary game can be in any of the wagering or non-wagering formats as described above (slots, video poker, etc.). A bonus feature or secondary game may also be similar to the main game through the use of additional random numbers in order to continue randomized, wager-based game play. A bonus feature or secondary game may include any additional game play and grant awards based on any particularized triggers built into the main game of the game machine. It should be noted that the game may only include the main game 80. Alternatively, the game may include the main game 80 and one or more bonus features and/or one or more secondary games. It should be noted that the present invention is not limited to any specific bonus feature or secondary game (or type thereof). Exemplary bonus features or secondary games are disclosed in U.S. Pat. Nos. 7,824,260, 8,052,515, 8,096,869, 8,303,397, and U.S. Patent Application Publication No. 2011/0223985, all of which are hereby incorporated by reference.

Figure 7:
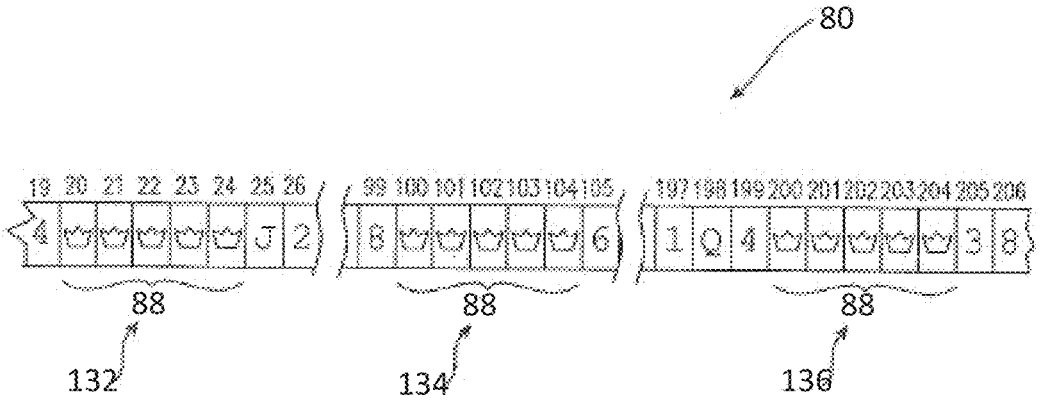
FIG. 7 is a schematic arrangement of elements on an inner reel.

In one preferred embodiment of the invention, at least one reel, the first reel 102, is arranged to have at least one run of an identical symbol in each of a number of consecutive symbol positions 112. The arrangement is shown schematically in FIG. 7 where portions of the first reel 102 are shown in strip form and, for example, a run of kings (crown symbol) is arranged for display in runs of five consecutive game symbols 88 at three locations 132, 134, and 136 respectively. The three runs of consecutive elements in this example are elements 20 to 24, 100 to 104 and 200 to 204, within the 256-element length of the strip. In this preferred embodiment, the number of elements in a run and the location of the consecutive run or runs within the strip are predetermined and remain constant for each game played on the machine. The identical symbol which populates these consecutive run or runs of elements may be considered as one of a set of "inner reel" symbols.

The controller determines the identical symbol to be displayed in each consecutive element of the run or runs of consecutive elements in which the symbol is to be shown. The selection of the identical symbol is through a notional rotation of an "inner reel" 140 shown as a strip of elements and symbols in FIG. 8. This "inner reel" is in effect a look-up table and is not displayed, but its simulated rotation and "coming to rest" determines which symbol will populate the run or runs of consecutive elements of the left-most reel.

The symbols of the "inner reel" or look-up table from which the selection is made, are a sub-set of the set of symbols displayed in the remaining non-"inner reel" elements of the left-most reel. Thus, where the symbols are those of a suit of cards, the "inner reel" symbols may be those of the Ace, King, Queen and Jack, sometimes called the trump or court cards. The look-up table could also include a "wild" or "scatter" symbol. As previously noted, the arrangement or ordering of the symbols in the elements of the reel, other than the consecutive run or runs of elements, remain constant for every game, only the selection of the identical symbol from a look-up table 140 is performed anew for each new play of a game.

Figure 8:
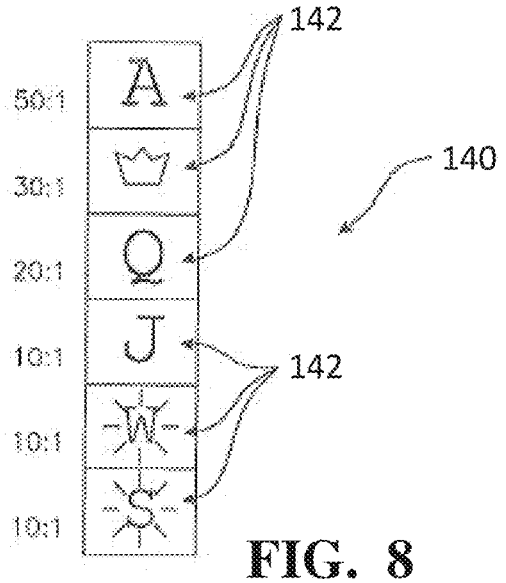
FIG. 8 is a representation of a look up table for an inner reel.

The symbols 142 of the look-up table 140 do not all require the same probability of selection and may also be assigned a hierarchy of probability. For example, those symbols where a winning combination grants a player a relatively higher value prize, such as the ace and the king, may have an inversely proportional probability of being selected as an "inner reel" symbol. An example of the look-up table is illustrated in FIG. 8.

The reels are now spun as normal. The player will notice the run or runs of identical symbols passing through the display 12 for each revolution of the first reel 102, thereby providing a heightening of interest, since the odds of a winning arrangement of symbols appearing on a pre-defined pay line in the matrix at the conclusion of the game sequence will be increased.

In another preferred embodiment of the invention, the second reel 104, that is the second reel from the left in this example, may also be modified to include at least one run of consecutive elements displaying the same "inner reel" symbol as that used to populate the elements of the consecutive run or runs of the left-most reel. As for the first reel 102, left-most reel, the number and location of the consecutive elements of the potential run or runs within the strip of elements forming the simulated reel, is predetermined and remains constant.

Prior to modification, all the elements of the second reel (and likewise those of the third fourth and fifth reel) are randomly populated with symbols from the set of available symbols. Unless modification is triggered in the manner explained below, the ordering of these symbols within the elements of the reels remains constant for every game; only those symbols of the potential run or runs being displaced should a modifying event occur.

Figure 9A:
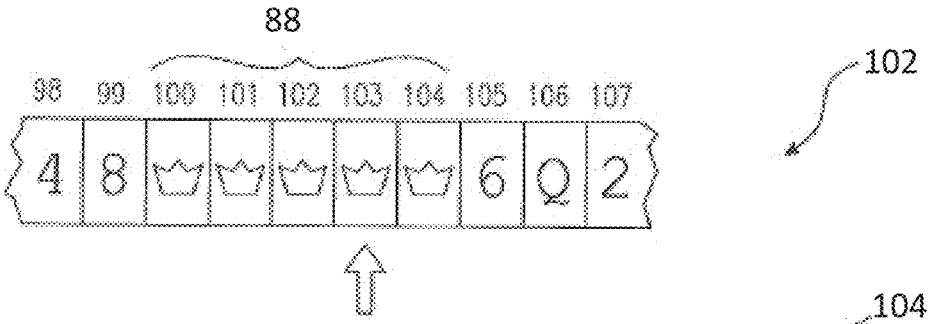
FIG. 9A is a representation of the left-most reel.
Figure 9B:
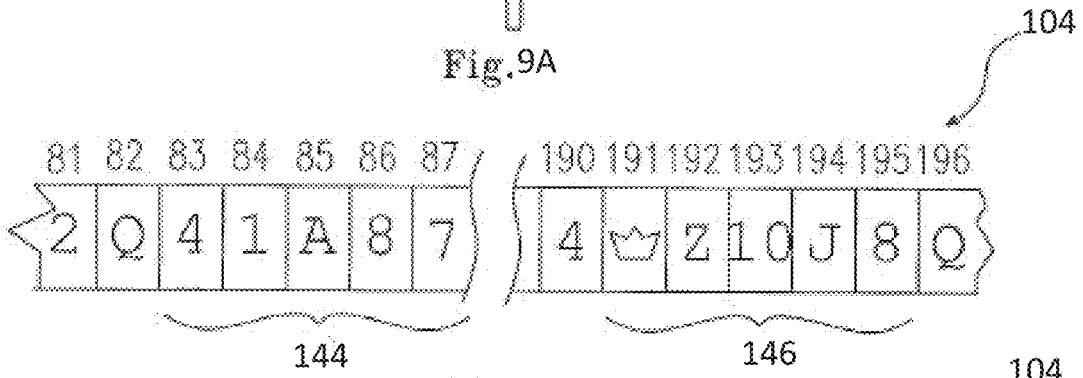
FIG. 9B is a representation of a subsequent reel.
Figure 9C:
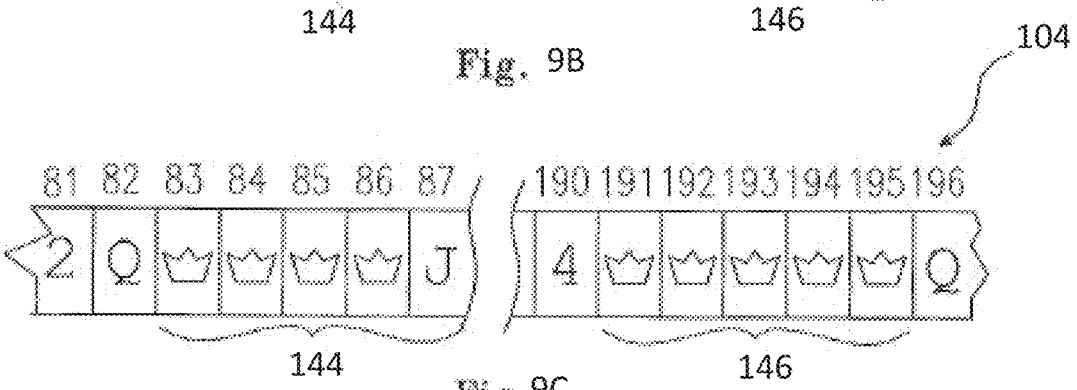
FIG. 9C is a representation of a subsequent reel.

The populating of the potential "inner reel" elements of the second reel 104, and of any subsequent reels, is dependent on the potential win element for the first, or preceding reel, which was randomly selected by the game controller, lying within a run of consecutive elements of that reel. For example if, as shown in FIG. 9A, in the first reel 102, which has consecutive runs comprising the elements as numbered in the embodiment above, the potential win element selected is element number 103, the second reel 104 will be modified. Second reel 104 in this example has two potential runs 144 and 146 of consecutive "inner reel" elements, element numbers 83 to 87 and 191 to 195 respectively, which in a default state are randomly populated from the set of available symbols as shown in FIG. 9B. However, because the selected potential win element 103 of reel 102 falls within a run of elements 88, the potential "inner reel" elements 83 to 87 and 191 to 195 of second reel 104 are replaced with the same identical symbol as used for the consecutive run or runs of the first reel 102 as shown in FIG. 9C.

A player will now discern a bias of symbols, (in our example crown symbols), in both the first, left-most, and second reels as these are spun during the play of a game. The effect is clearly an increase in the probability of a winning combination of symbols appearing along a pre-defined pay line within the matrix and consequently a raised level of interest in the outcome of the game for the player.

The same process of populating potential "inner reel" elements with the "inner reel" symbol of the preceding reel, may be sequentially applied to the third, fourth and fifth reels. As described for the second reel, the modification of a succeeding reel depends on the selected potential win element of the preceding reel falling within a run of "inner reel" elements of that reel.

In one preferred form of this embodiment, a player is made aware of the populating of one or more consecutive runs of the left-most reel with the identical symbol. This may be done prior to the main game sequence, for example, by a slower pre-spin of only the left-most reel. If any further reels are so populated, each may be pre-spun sequentially.

The displayed game rules and experience will alert a player to the fact that the potential winning element for a given reel is positioned somewhere within the run, or one of the runs of consecutive elements populated with the identical symbol if the second and any subsequent reels are also pre-spun to display a run or runs of that symbol. The player will appreciate that the probability of a winning combination occurring increases with each additional reel which is pre-spun to display its run or runs of elements with the same symbol.

The above described embodiments may be applied to a main game of a gaming machine or to a bonus feature game offered as a result of some triggering event in a main game. The above embodiments may also be utilized as the triggering event for additional features within a main game or bonus game, such as the dual symbol feature discussed in further detail below.

In another preferred embodiment of the invention as adapted for a bonus feature game, the number of elements comprising a run of identical "inner reel" symbols and the number of such runs in any given reel is not constant but may be determined in a number of ways. Thus, in at least one preferred embodiment, the number of elements comprising a run may be a function of the amount of a bet placed by the player on the main game which triggered the feature game, or as a function of accumulated throughput of bets over a given time period. In one special case, all the elements of the first left-most reel may be populated by the same "inner reel" symbol.

Likewise, the number of runs in a given reel may be a function also of the betting pattern preceding the conferring of the feature game or alternatively, may be a function of the particular triggering event of the main game which led to the bonus feature game.

Dynamic Positions/Activation Zone

In another preferred embodiment, the run of identical symbols 88 may be used to trigger a dynamic positions feature. This feature will modify the payout of multiple lines by changing the amount of symbols within multiple cells within the grid 90.

In one embodiment, the game machine 10 comprises a display device 12 for displaying a game and a controller 16. The gaming controller is then configured to display a game 80, the game 80 includes a plurality of reels 98 and each reel 98 displays a plurality of symbols 88. At least one reel 98 also includes an activation zone 150. The activation zone 150 can have at least one symbol, but may also have more than one symbol depending on the desires game mechanics of the game 80. The controller 16 determines the number of symbols 88 within the activation zone 150, randomly determines an outcome of the game 80, and displays the outcome of the game including the activation zone 150. Within the outcome of the game 80, the activation zone 150 includes the determined number of symbols 88. The determined number of symbols 88 may be the symbol 88, a specific symbol 88 used solely within the activation zone 150, or some additional symbol 88 that is used in response to the triggering condition registered by the controller 16.

In another embodiment, the game machine 10 has at least one reel with a plurality of symbol positions 112. The activation zone 150 includes a predetermined number of symbol positions 112, with each symbol position 112 configured to display at least one symbol 88.

In another embodiment, the controller 16 is configured to determine a ratio associated with the activation zone 150 and select the number of symbols 88 displayed within the activation zone 150 as a function of the ratio. Each ratio may be randomly determined relative to the number of symbols within the activation zone as a whole number greater than or equal to 1. In order to have larger determined symbols 88 within the activation zone, the ratio will then determined a whole number of prior symbols within the activation that will be replaced by one determined symbol. In one embodiment each of the symbols is equal in size. Some embodiments can apply multiple sizes to the symbols 88 within the activation zone 150 in order to further vary the game play as presented. Accordingly, each symbol position 112 may include the same number of symbols within the activation zone 150. Alternate embodiment may vary the number of symbols within each symbol position 112 within the activation zone 150. This variation may be based on the determined ratio or the trigger condition detected by the controller 16.

Furthermore, at least one symbol 88 may be different in size from at least one other symbol 88 within the activation zone 150. As stated above, different determined symbols 88 within the activation may be different in size within the activation zone. This variation in sizes between the symbols 88 may be based on the symbol type, the trigger condition detected by the controller 16, or another element present within game play.

In another embodiment, at least one symbol position 112 includes a different number of symbols 88 than another symbol position 112 within the activation zone 150. Selecting a different numbers of symbols may be based on factors including: the type of symbol 88 within the activation zone 150, the application of different ratios applied to the activation zone 150, and the trigger condition detected by the controller 16.

In another embodiment, the ratio is selected from a plurality of ratios, each of the plurality of ratios including an associated selection probability. The controller 16 is further configured to select a ratio as a function of the associated selection probability. This allows for the random selection of ratio that is applied to the activation zone 150 in order to place the determined number of symbols 88 into the symbol positions 112.

In another embodiment, the controller 16 is further configured to select a symbol 88 being displayed within the activation zone 88 with the number of symbols 88 displayed within the activation zone 150 being a function of the selected symbol 88. Various game symbols 88 may have additional game mechanics attached to them which are detected by the game controller 16 upon selection of the determined symbols. These additional game mechanics may determine the number of symbols display within the activation zone 150. These additional game mechanics may includes ratios that may be used to determine the number of symbols within each symbol position or the total number of symbols within the whole activation zone 150.

In one embodiment, every determined symbol 88 in the activation zone 150 is the same symbol. Whereas in another embodiment, every symbol 88 within each symbol position 112 within the activation zone 150 is the same. Whether to replace every symbol 88 within the activation zone 150 with the same symbol or only to match symbols within each symbol position 112 may depend on various factors, including the trigger condition detected by the controller 16.

In one embodiment, the trigger condition may be the presence of the entire activation zone in the outcome of the game 84 (IE within the display area 86). In another embodiment, the trigger condition may be the presence of a portion of the activation zone in the outcome of the game 84 (IE within the display area 86).

In another embodiment, the game machine 10 further including a least one obscure symbol 152. The obscure symbol 152 is configured to the size of each symbol position 112 within the activation zone and is located within the activation prior to the detection of a trigger condition by the controller 16. The controller 16 is configured to replace the at least one obscure symbol 152 with another symbol 88 as a function of the ratio and in response to the trigger condition detected by the controller 16.

Figure 12:
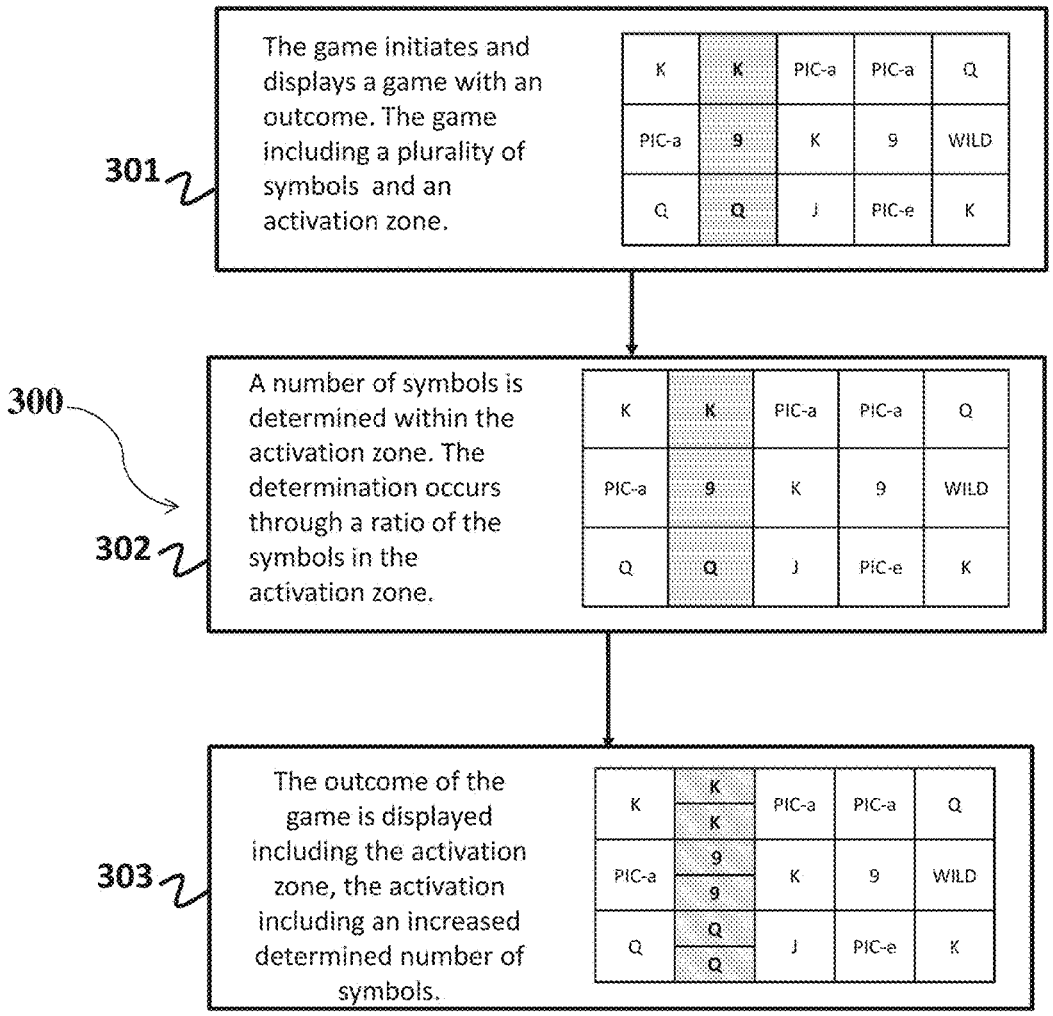
FIG. 12 is a method flowchart of the method according to an embodiment of the present invention.
Figure 13:
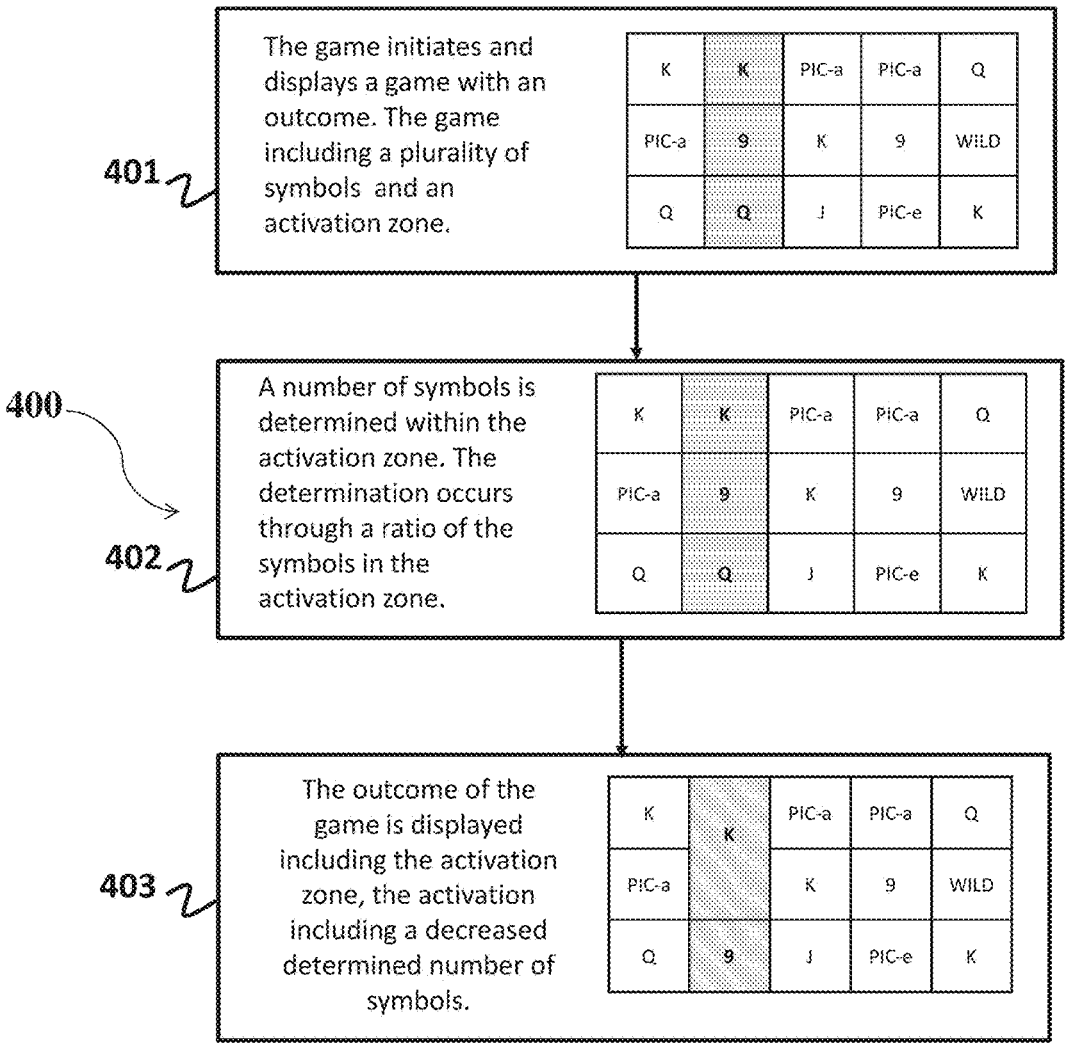
FIG. 13 is a method flowchart of the method according to an embodiment of the present invention.

Another embodiment within the present disclosure (shown in FIG. 12) illustrates a method 300 of providing a game to a player. The method involves a game machine 10 including a display device 12 and a controller 16. The method 300 comprises the steps of: displaying 301 the game through the display device, the game including a plurality of reels displaying a plurality of symbols, at least one reel including an activation zone, the activation zone having at least one symbol. The game controller determines 302 the number of symbols 88 within the activation zone 150, determines an outcome of the game 84, and displays 303 the outcome of the game including the activation zone 150. The activation zone 150 includes the determined number of symbols 88.

In another embodiment, the method 300 further includes the steps of determining a ratio 303 associated with the activation zone 150 and selecting the number of symbols displayed within the activation zone as a function of the ratio.

In another embodiment the method 300 further including the step of selecting a symbol to display within the activation zone, the number of symbols displayed at step 303 within the activation zone being a function of the selected symbol.

Figure 14:
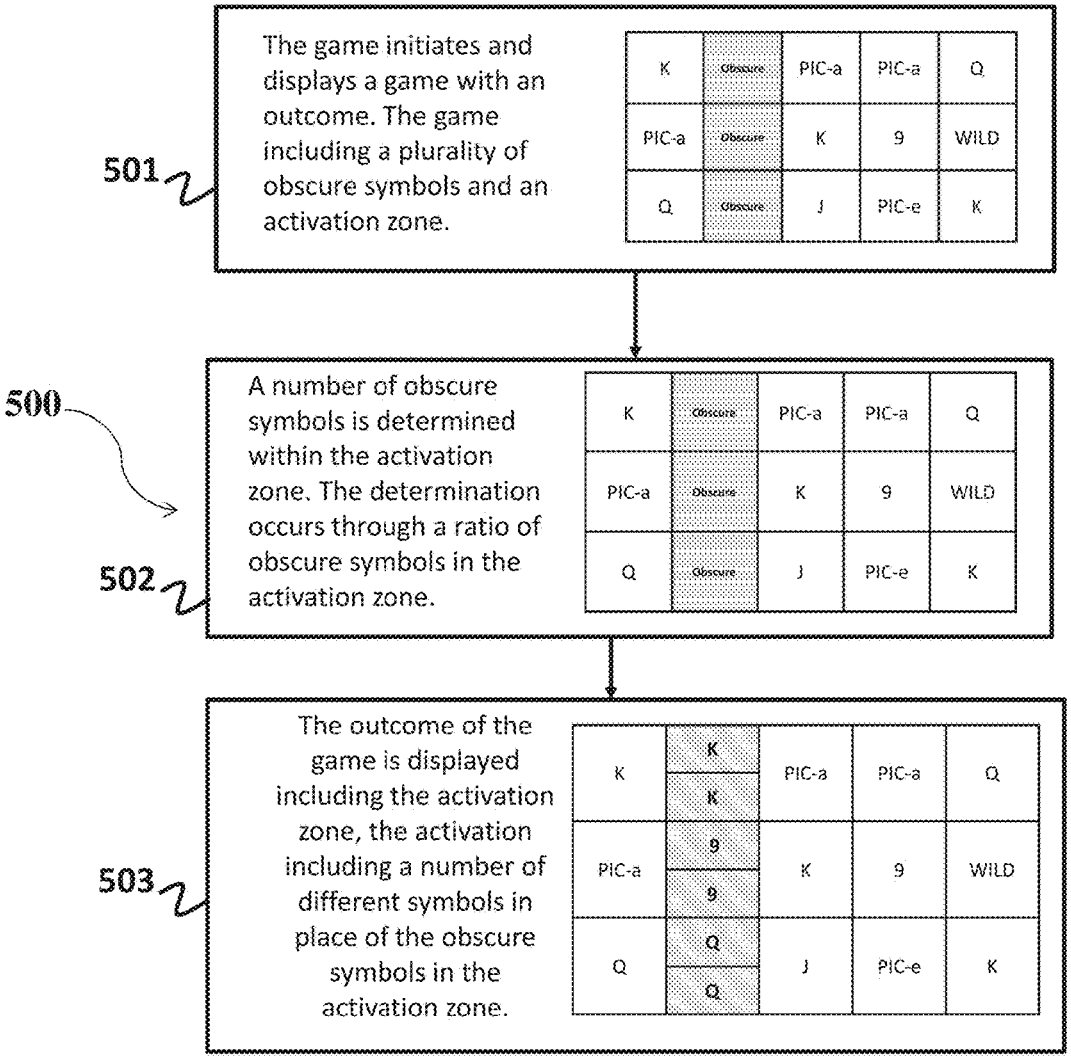
FIG. 14 is a method flowchart of the method according to an embodiment of the present invention.

In another embodiment, as shown in FIG. 14 as method 500, the game machine 10 further includes a least one obscure symbol 152, the obscure symbol 152 configured to size of each symbol position 112 within the activation zone 150. The method 500 further includes the step of replacing 503 at least one obscure symbol with another symbol as a function of the ratio in response to the trigger condition detected by the game controller 16.

Figure 15:
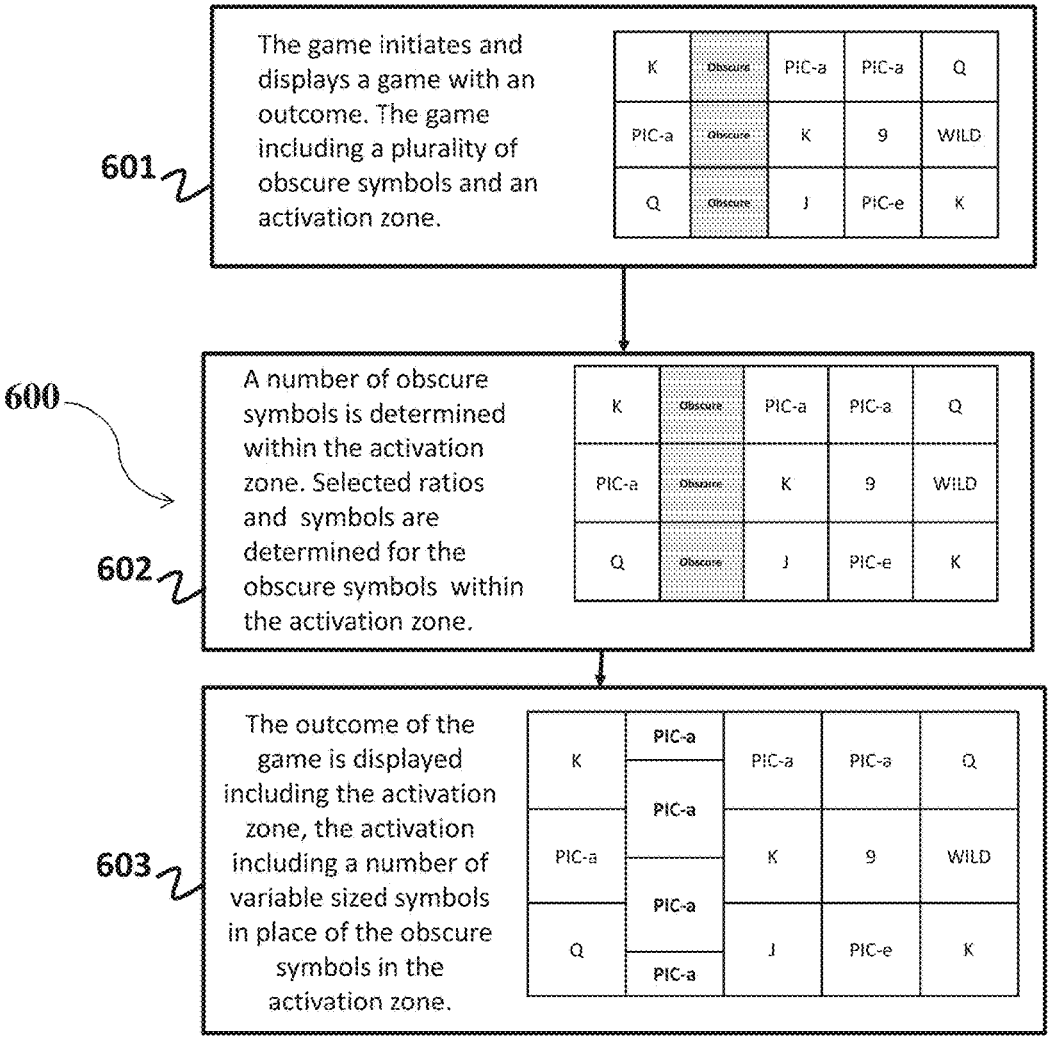
FIG. 15 is a method flowchart of the method according to an embodiment of the present invention.

In another embodiment, as shown in FIG. 15 as method 600, the game machine 10 may also utilize multiple ratios in order generate symbols 88 of multiple sizes within the activation zone 150. Method 600 begins by initiating and displaying a game 601 including a series of obscure symbols 152. The use of obscure symbols 152 as the trigger event for determining the activation zone is used as example and not meant to limit the use of alternate trigger events. Multiple ratios are determined 602 and applied to the symbol position 112 occupied by the obscure symbols 152 within the activation zone 150. This generates symbols 88 of varied sizes within the activation zone 150. These multiple ratios may be related to one another (i.e. applying a 1:2 ratio and a 2:1 to symbols 88 within the activation zone 150) or may be independently determined. The application of the ratios to the symbols 88 within the activation zone 150 may dependent on various factors such as symbol type, position of the symbol within the activation zone 150, and/or the trigger event detected within the game.

Another embodiment within the present disclosure provides for a non-transitory information recording medium on which a computer readable program is recorded that causes a computer to function as a game machine for providing a game to a player. The game machine 10 comprises a display device 12 for displaying a game and a controller 16. The gaming controller is then configured to display a game 80, the game 80 includes a plurality of reels 98 and each reel 98 displays a plurality of symbols 88. At least one reel 98 also includes an activation zone 150. The activation zone 150 can have at least one symbol, but may also have more than one symbol depending on the desires game mechanics of the game 80. The controller 16 then determines the number of symbols 88 within the activation zone 150, randomly determines an outcome of the game 80, and displays the outcome of the game including the activation zone 150. Within the outcome of the game 80, the activation zone 150 includes the determined number of symbols 88. The determined number of symbols 88 may be the symbol 88, a specific symbol 88 used solely within the activation zone 150, or some additional symbol 88 that is used in response to the triggering condition registered by the controller 16.

N-Sided Game Symbols

Figure 10:
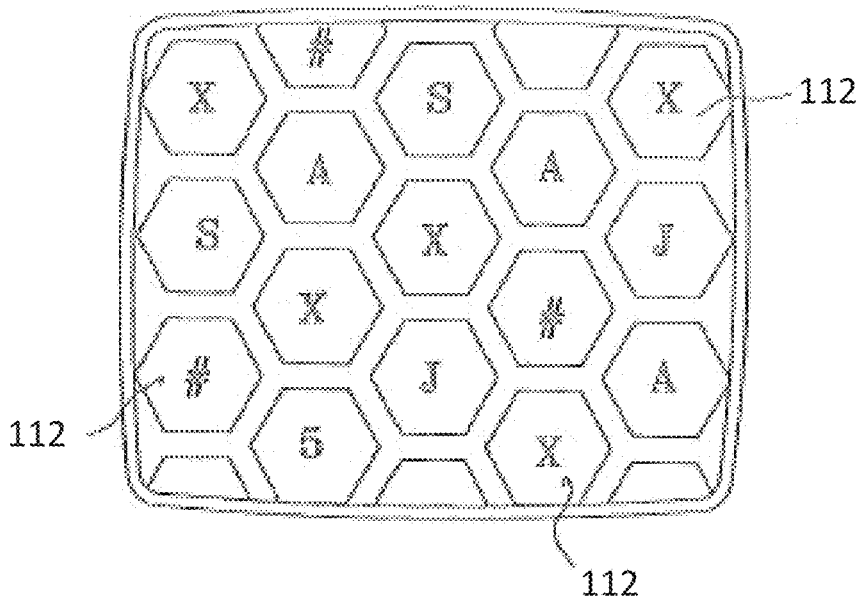
FIG. 10 is a view of the game screen.
Figure 11:
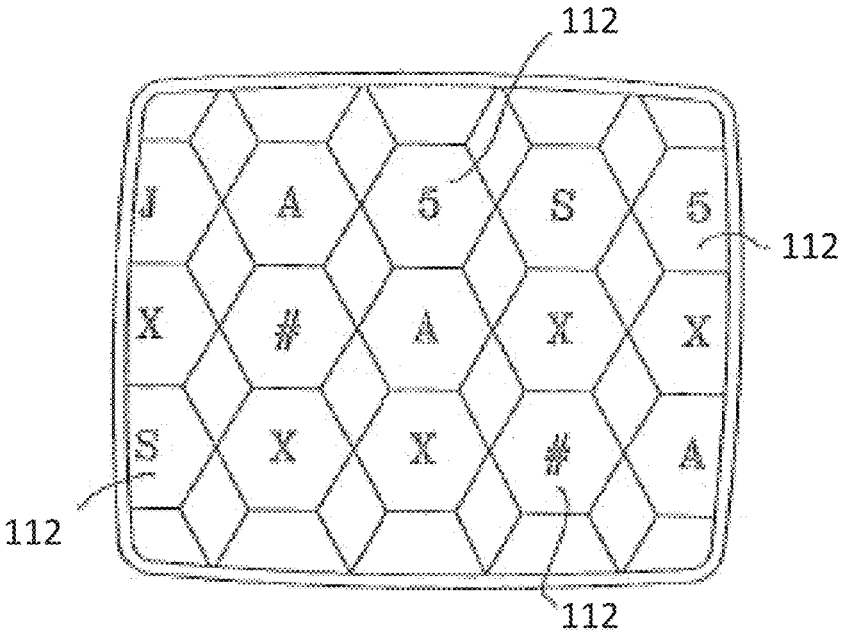
FIG. 11 is an alternate view of the game screen.

The game symbols 88 of any of the above described embodiments may be of conventional rectangular configuration, but in at least one preferred embodiment shape of the symbol position 112 containing the game symbol 88 may be any N-sided figure, where N may take the value 1 (thus a circular field) or any value from 3 to 20, with 20 being used as an illustrative upper limit given current limits on resolution and pixel density for the display device 12 in use within the gaming machine 10. In at least one preferred form of an N-sided symbol position 112, as shown in FIGS. 10 and 11, the symbol positions 112 are hexagon shape for the value of N=6.

Stand-alone Gaming Machines

As shown in FIG. 1, any of the above described embodiments for use on electronic display gaming machines may be incorporated into a stand-alone gaming machine 10 provided with a single display unit 12. In this implementation of games according to the invention, both main games and feature games (if offered) are displayed on the single display unit.

Stand-alone Gaming Machines with Secondary Display Unit

In a further preferred embodiment of the invention as shown in FIG. 1, a stand-alone gaming machine 10 is provided with a secondary display unit 56 as well as a first display unit 54. Expansion of the display area 86 may be expanded onto both screens in order to provide a larger visual experience for the player.

Elements of the Embodiments Generally

Exemplary embodiments of these systems and methods are described above in detail. The systems and methods are not limited to the specific embodiments described herein, but rather, components of the systems and/or steps of the methods may be utilized independently and separately from other components and/or steps described herein. For example, the systems may also be used in combination with other systems and methods, and is not limited to practice with only the system and method as described herein.

The gaming controller 16 and likewise any computing device, or computer, such as described herein, may include at least one or more processors or processing units and a system memory. The gaming controller may typically also include at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention may be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A game machine for providing a game to a player, comprising:

a display device for displaying a game;

a controller configured to:

display the game including a plurality of reels displaying a plurality of symbols, identify an activation zone on at least one reel, the activation zone having a plurality of symbol positions, each of the symbol positions configured to display at least one symbol;

determine a number of symbols within the activation zone;

initiate play of the game by spinning the reels;

randomly determine an outcome of the game by utilizing a random number generated by a random number generator;

terminate play of the game by stopping the reels; and display the outcome of the game including the activation zone, the activation zone including the determined number of symbols.

2. The game machine, as in claim 1, wherein the controller is further configured to select a symbol being displayed within the activation zone, the number of symbols displayed within the activation zone being a function of the selected symbol.

3. The game machine, as in claim 1, wherein every symbol in the activation zone is the same symbol.

4. The game machine, as in claim 1, wherein every symbol within each symbol position within the activation zone is the same.

5. The game machine, as in claim 1, wherein the controller is configured to detect a trigger condition and the trigger condition is the presence of the entire activation zone in the outcome of the game.

6. The game machine, as in claim 1, wherein the controller is configured to detect a trigger condition and the trigger condition is the presence of a portion of the activation zone in the outcome of the game.

7. A game machine for providing a game to a player, comprising:

a display device for displaying a game;

a controller configured to:

display the game including a plurality of reels displaying a plurality of symbols, identify an activation zone on at least one reel, the activation zone having at least one symbol;

determine a number of symbols within the activation zone;

initiate play of the game by spinning the reels;

randomly determine an outcome of the game by utilizing a random number generated by a random number generator;

terminate play of the game by stopping the reels;

display the outcome of the game including the activation zone, the activation zone including the determined number of symbols;

the at least one reel having a plurality of symbol positions, the activation zone including a predetermined number of symbol positions, each symbol position configured to display at least one symbol; and the controller being configured to determine a ratio associated with the activation zone and select the number of symbols displayed within the activation zone as a function of the ratio.

8. The game machine, as in claim 7, wherein each of the symbols is equal in size.

9. The game machine, as in claim 8, wherein each symbol position includes the same number of symbols.

10. The game machine, as in claim 7, wherein at least one symbol is different in size from at least one other symbol within the activation zone.

11. The game machine, as in claim 7, wherein at least one symbol position includes a different number of symbols than at least one other symbol position.

12. The game machine, as in claim 7, wherein the ratio is selected from a plurality of ratios, each of the plurality of ratios including an associated selection probability, the controller further configured to select a ratio as a function of the associated selection probability.

13. The game machine, as in claim 7, the game machine further including a least one obscure symbol, the obscure symbol configured to size of each symbol position within the activation zone.

14. The game machine, as in claim 13, wherein the controller is configured to detect a trigger condition and to replace the at least one obscure symbol with another symbol as a function of the ratio in response to the trigger condition.

15. A method of providing a game to a player through a game machine including a display device and a controller, the method comprising the steps of:

displaying the game through the display device, the game including a plurality of reels displaying a plurality of symbols, identifying an activation zone on at least one reel, the activation zone having a plurality of symbol positions, each of the symbol positions configured to display at least one symbol;

determining a number of symbols within the activation zone;

initiating play of the game by spinning the reels;

randomly determining an outcome of the game by utilizing a random number generated by a random number generator;

terminating play of the game by stopping the reels; and displaying the outcome of the game including the activation zone, the activation zone including the determined number of symbols.

16. The method, as in claim 15, wherein every symbol in the activation zone is the same symbol.

17. The method, as in claim 15, wherein every symbol within each symbol position within the activation zone is the same.

18. The method, as in claim 15, further including the step of detecting a trigger condition by the controller, wherein the trigger condition is the presence of the entire activation zone in the outcome of the game.

19. The method, as in claim 15, further including the step of detecting a trigger condition by the controller, wherein the trigger condition is the presence of a portion of the activation zone in the outcome of the game.

20. A method of providing a game to a player through a game machine including a display device and a controller, the method comprising the steps of:

displaying the game through the display device, the game including a plurality of reels displaying a plurality of symbols, identifying an activation zone having a predetermined number of symbol positions on at least one reel, each symbol position configured to display at least one symbol;

determining a number of symbols within the activation zone;

initiating play of the game by spinning the reels;

randomly determining an outcome of the game by utilizing a random number generated by a random number generator;

terminating play of the game by stopping the reels;

displaying the outcome of the game including the activation zone, the activation zone including the determined number of symbols;

the at least one reel having a plurality of symbol positions, the activation zone including a predetermined number of symbol positions, each symbol position configured to display at least one symbol; and determining a ratio associated with the activation zone and selecting the number of symbols displayed within the activation zone as a function of the ratio.

21. The method, as in claim 20, wherein each of the symbols is equal in size.

22. The method, as in claim 21, wherein each symbol position includes the same number of symbols.

23. The method, as in claim 20, wherein at least one symbol is different in size from at least one other symbol within the activation zone.

24. The method, as in claim 20, wherein at least one symbol position includes a different number of symbols than at least one other symbol position.

25. The method, as in claim 20, wherein each of the plurality of ratios further includes an associated selection probability, the method further including the step of selecting a ratio as a function of the associated selection probability.

26. The method, as in claim 20, the game machine further including a least one obscure symbol, the obscure symbol configured to size of each symbol position within the activation zone.

27. The method, as in claim 26, further including the step of detecting a trigger condition by the controller and replacing the at least one obscure symbol with another symbol as a function of the ratio in response to the trigger condition.

28. A method of providing a game to a player through a game machine including a display device and a controller, the method comprising the steps of:

displaying the game through the display device, the game including a plurality of reels displaying a plurality of symbols, identifying an activation zone having a predetermined number of symbol positions on at least one reel, each symbol position configured to display at least one symbol;

determining a number of symbols within the activation zone;

initiating play of the game by spinning the reels;

randomly determining an outcome of the game by utilizing a random number generated by a random number generator;

terminating play of the game by stopping the reels;

displaying the outcome of the game including the activation zone, the activation zone including the determined number of symbols; and selecting a symbol to display within the activation zone, the number of symbols displayed within the activation zone being a function of the selected symbol.

29. A non-transitory information recording medium on which a computer readable program is recorded that causes a computer to function as a game machine for providing a game to a player, comprising:

a display device for displaying a game;

a controller configured to:

display the game including a plurality of reels displaying a plurality of symbols, identify an activation zone on at least one reel, the activation zone having a plurality of symbol positions, each of the symbol positions configured to display at least one symbol;

determine a number of symbols within the activation zone;

initiate play of the game by spinning the reels;

randomly determine an outcome of the game by utilizing a random number generated by a random number generator;

terminating play of the game by stopping the reels; and display the outcome of the game including the activation zone, the activation zone including the determined number of symbols.

* * * * *